US009333385B2

(12) United States Patent
Hinds et al.

(10) Patent No.: US 9,333,385 B2
(45) Date of Patent: May 10, 2016

(54) EXERCISE DEVICE WITH ELASTIC MEMBERS AND WEBBING

(71) Applicant: PIVOTAL 5, LLC, Chicago, IL (US)

(72) Inventors: Robert S. Hinds, Madison, WI (US); Glenn Polinsky, Waunakee, WI (US)

(73) Assignee: PIVOTAL 5, LLC, Chicago, IL (US)

( * ) Notice: Subject to any disclaimer, the term of this patent is extended or adjusted under 35 U.S.C. 154(b) by 172 days.

(21) Appl. No.: 13/943,112

(22) Filed: Jul. 16, 2013

(65) Prior Publication Data

US 2014/0024508 A1 Jan. 23, 2014

Related U.S. Application Data

(60) Provisional application No. 61/672,499, filed on Jul. 17, 2012.

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 21/055*** | (2006.01) |
| ***A63B 21/16*** | (2006.01) |

(52) U.S. Cl.

CPC ..... *A63B 21/02* (2013.01); *A63B 21/00043* (2013.01); *A63B 21/00061* (2013.01); *A63B 21/00185* (2013.01); *A63B 21/0442* (2013.01); *A63B 21/0552* (2013.01); *A63B 21/0557* (2013.01); *A63B 21/1645* (2013.01); *A63B 21/4035* (2015.10); *A63B 2225/09* (2013.01)

(58) Field of Classification Search

CPC ..... A63B 21/02; A63B 21/0442; A63B 21/00043; A63B 21/00185; A63B 21/00061; A63B 21/1645; A63B 2225/09; A63B 21/002; A63B 21/0023; A63B 2021/0026; A63B 21/055; A63B 21/0552; A63B 21/0555; A63B 21/0557; A63B 21/1415; A63B 21/1465; A63B 21/1469; A63B 23/12; A63B 23/1236; A63B 69/004

USPC ..... 482/44–50, 92, 121–139, 148, 482/906–908, 910

See application file for complete search history.

(56) References Cited

U.S. PATENT DOCUMENTS

| | | | | |
|---|---|---|---|---|
| 1,402,179 | A * | 1/1922 | Piscitelli | 482/124 |
| 1,633,124 | A * | 6/1927 | Noe | 482/126 |
| 4,327,909 | A * | 5/1982 | Neufeld | 482/124 |

(Continued)

FOREIGN PATENT DOCUMENTS

FR 2980113 A1 * 3/2013

*Primary Examiner* — Oren Ginsberg
*Assistant Examiner* — Joshua Lee
(74) *Attorney, Agent, or Firm* — Ladas & Parry LLP

(57) ABSTRACT

An exercise device for various exercises includes a pair of bridges on opposing ends of a relatively inelastic, flat central webbing/band/belt, with an elastic member extending from each bridge. The elastic members themselves may serve as grips (for hands, feet, ankles, arms, wrists, etc.), or separate grips (such as those of a handle) may be used. The elastic members include a pair of bulbs on opposing ends of a body, and may be secured to the bridges and handle grips via cradles (in which the bulbs may be lodged) and/or channels (through which the bodies may be passed). A user may push or pull on grips with hands or feet to stretch the elastic members while exercising. The elastic members are preferably exchangeable to allow the user to change workout intensity by swapping in elastic members having different elasticities/lengths that provide different resistances.

17 Claims, 3 Drawing Sheets

(56) References Cited

U.S. PATENT DOCUMENTS

| | | | | | |
|---|---|---|---|---|---|
| 4,690,402 | A * | 9/1987 | Basting | 482/125 |
| 5,141,223 | A * | 8/1992 | Block | 482/124 |
| 5,362,295 | A * | 11/1994 | Nurge | 482/124 |
| 5,792,034 | A * | 8/1998 | Kozlovsky | 482/124 |
| 5,885,175 | A * | 3/1999 | Marquez | 473/464 |
| 6,551,221 | B1 * | 4/2003 | Marco | 482/74 |
| 6,659,921 | B2 * | 12/2003 | Vernon | 482/124 |
| 6,921,357 | B2 * | 7/2005 | Basting | 482/121 |
| 7,147,590 | B2 * | 12/2006 | Toven | 482/51 |
| 7,217,227 | B2 * | 5/2007 | Finn | 482/92 |
| 7,549,948 | B2 * | 6/2009 | Makofsky | 482/92 |
| 7,722,508 | B2 * | 5/2010 | Hetrick | 482/95 |
| 2002/0160891 | A1 * | 10/2002 | Gallagher | 482/123 |
| 2005/0059537 | A1 * | 3/2005 | Hull | 482/124 |
| 2006/0217247 | A1 * | 9/2006 | Potak et al. | 482/121 |
| 2009/0105053 | A1 * | 4/2009 | Hetrick | 482/133 |
| 2010/0279830 | A1 * | 11/2010 | Snagg | 482/124 |
| 2012/0053027 | A1 * | 3/2012 | Hetrick | 482/124 |
| 2012/0245002 | A1 * | 9/2012 | Todd | 482/124 |
| 2013/0053225 | A1 * | 2/2013 | Meyer | 482/124 |
| 2013/0331241 | A1 * | 12/2013 | Spina | 482/124 |
| 2014/0315697 | A1 * | 10/2014 | Alazet | 482/124 |
| 2014/0371039 | A1 * | 12/2014 | Burrell | 482/124 |

* cited by examiner

EXERCISE DEVICE WITH ELASTIC MEMBERS AND WEBBING

CROSS-REFERENCE TO RELATED APPLICATIONS

This application claims priority under 35 USC §119(e) to U.S. Provisional Patent Application 61/672,499 filed Jul. 17, 2012, the entirety of which is incorporated by reference herein.

FIELD OF THE INVENTION

This document concerns an invention relating generally to a versatile exercise device usable for various exercises in multiple configurations, and more specifically to an exercise device having stretchable elastic members extending from relatively inelastic central webbings.

BACKGROUND OF THE INVENTION

Elastic cables are able to resist stretching to varying degrees, and can be used in different configurations to simulate weights in various exercises. An elastic cable can be secured to exercise bar sections, handles, etc. to perform desired exercises. U.S. Pat. Nos. 6,923,750 and 6,497,641 to Hinds (incorporated by reference herein) show elastic cables with elongated middle portions and (male) plugs at opposing ends. Handles with (female) cable pockets are able to receive the elastic cable plugs therein. The elongated middle portions of the elastic cables are able to pass through the cable pockets but the plugs are not able to pass therethrough. The plugs allow elastic cables of desired elasticities to be secured to the handles and swapped for other elastic cables. Traditional exercise devices with elastic cables (such as devices with a pair of handles bridged by an elastic cable), however, are not easily stabilized in various configurations to achieve a wide variety of exercises. They also tend not to allow for a change in resistance without replacement of its parts (such as replacement of an elastic cable having a first elasticity/length with another elastic cable having a second elasticity/length).

SUMMARY OF THE INVENTION

The invention, which is defined by the claims set forth at the end of this document, is directed to a versatile exercise device usable for various exercises in multiple configurations which at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Turning initially to FIGS. 1 and 2, an exemplary exercise device that illustrates preferred features of the invention is designated generally by the reference numeral 10. The exercise device 10, usable for various exercises in multiple configurations, includes a flat central webbing/band 100 with a first bridge 110 and a second bridge 120 on opposing ends 100A, 100B thereof. A first elastic member 130 extends from the first bridge 110, and a second elastic member 140 extends from the second bridge 120. The exercise device 10 may include a first loop 150 formed by the first bridge 110 and the first elastic member 130, and a second loop 160 formed by the second bridge 120 and the second elastic member 140. A first grip and a second grip may be a portion 170A, 170B of the first and second elastic members 130, 140, respectively, or portion 180A, 180B of a first handle 190 and a second handle 200, respectively. A user may push or pull on the first and second grips 170A, 170B/180A, 180B with his or her hands, feet, wrists, ankles, elbows, knees, etc. to move the first and second grips 170A, 170B/180A, 180B farther away from the first and second bridges 110, 120, stretching the first and second elastic members 130, 140 while engaging in various exercises. The dimensions and material of the central webbing 100 allows the user to more comfortably loop the exercise device 100 about his or her back. The first and second elastic members 130, 140 are preferably removably and replaceably securable to the first and second bridges 110, 120 to allow the user to change workout intensity by swapping in elastic members having different elasticities and/or lengths providing different resistances.

Each of the first and second elastic members 130, 140 includes a pair of elastic member bulbs/plugs 210A, 210B/220A, 220B on opposing ends of an elastic member body 210C/220C. (It is noted that portions 170A, 170B of the first and second elastic members 130, 140, discussed above, are part of the elastic member bodies 210C, 220C.) The elastic member bulbs 210A, 210B/220A, 220B have a diameter greater than a diameter of the elastic member bodies 210C/220C, and the elastic member bodies 210C/220C decrease in diameter when stretched beyond their resting lengths. The first bridge 110 may include a first bridge first cradle 230A and a first bridge second cradle 230B on opposing sides thereof, and the second bridge 120 may include a second bridge first cradle 240A and a second bridge second cradle 240B on opposing sides thereof. Each cradle is dimensioned to complementarily engage one of the elastic member bulbs 210A, 210B/220A, 220B, allowing the first and second elastic members 130, 140 to be securable to the first and second bridges 110, 120 via the cradles 230A, 230B/240A, 240B thereof. When one of the elastic member bulbs 210A, 210B/220A, 220B is received/lodged in one of the cradles 230A, 230B/240A, 240B, the elastic member bulb 210A, 210B/220A, 220B is restricted from exiting the cradle 230A, 230B/240A, 240B in a first direction along a cradle long axis (as oriented in FIG. 1, leftward for cradles 230A, 230B, and rightward for cradles 240A, 240B) while being relatively unrestricted from exiting the cradle 230A, 230B/240A, 240B in an opposing second direction along the cradle long axis (as oriented in FIG. 1, rightward for cradles 230A, 230B, and leftward for cradles 240A, 240B). Each cradle 230A, 230B/240A, 240B includes a cradle slit 250A, 250B/260A, 260B opening onto a cradle passageway 270A, 270B/280A, 280B. The cradle slit 250A, 250B/260A, 260B of each cradle 230A, 230B/240A, 240B is sized such that the elastic member body 210C/220C of each elastic member 130, 140 is restricted from passing through the cradle slit 250A, 250B/260A, 260B unless the elastic member body 210C/220C is stretched beyond its resting length.

When the ends 100A, 100B of the central webbing 100 are pulled apart such that the central webbing 100 is effectively planar and taut, the first and second bridges 110, 120 are a separation distance 290 apart from each other. This separation distance 290 is preferably adjustable by allowing the relative position of the first and second bridges 110, 120 with respect to the central webbing 100 to be changed. To allow such adjustability, the second bridge 120 may include a second bridge passageway 300 through which the central webbing 100 may pass. A webbing securing mechanism 310 (such as a cam mechanism) that is biased to secure the second bridge 120 to the central webbing 100 may be incorporated into the second bridge 120. The webbing securing mechanism 310 may include a webbing release lever 320 that is movable between a grip state (as in FIG. 1) in which the central webbing 100 is restricted from passing through the second bridge passageway 300 by the webbing securing mechanism 310, and a release state (as in FIG. 2) in which the central webbing 100 is not restricted from passing through the second bridge passageway 300 by the webbing securing mechanism 310. The separation distance 290 between the first bridge 110 and the second bridge 120 may be adjusted when the webbing release lever 320 of the webbing securing mechanism 310 is in the release state. A webbing stop 330 may be incorporated at the webbing second end 100B (for example, by folding over a portion of the central webbing 100 and sewing it back onto itself) as a safety measure to restrict the second bridge 120 from sliding beyond the webbing second end 100B and entirely off the central webbing 100. A decrease in the separation distance 290 may increase a user's exertion during exercises by increasing the length to which the first and second elastic members 130, 140 are stretched during repeating exercise motions.

Referring to FIGS. 1 and 3, a device anchor 340 may be used to anchor the exercise device 10 to a structure such as a door. The device anchor 340 may include an elongated strapping member 350 extending from a strapping first end 350A to a strapping second end 350B. The device anchor 340 may further include an anchor first loop 360 extending from the strapping first end 350A, and an anchor second loop 370 extending from the strapping second end 350B, the anchor first and second loops 360, 370 able to receive the first and second elastic members 130, 140 therethrough, respectively. The anchor first and second loops 360, 370 may include first and second cable cradles 380, 390 for helping orient and hold elastic members 130, 140 in place, and for decreasing friction between elastic members 130, 140 and the anchor loops 360, 370. A first buckle 400 and a second buckle 410 may be provided on the strapping member 350 between the strapping first end 350A and the strapping second end 350B. Each of the first and second buckles 400, 410 may include a buckle passageway 420, 430 through which the strapping member 350 passes, and a buckle securing mechanism 440, 450 biased to secure the buckle to the strapping member 350. A buckle release lever 460, 470 of the buckle securing mechanism 440, 450 is movable between a buckle grip state in which the strapping member 350 is restricted from passing through the buckle passageway 420, 430 by the buckle securing mechanism 440, 450, and a buckle release state in which the strapping member 350 is not restricted from passing through the buckle passageway 420, 430 by the buckle securing mechanism 440, 450. In the grip state of the buckle release levers 460, 470, roughened/toothed/spiked buckle lever surfaces 550A, 550B are pressed against the strapping member 350.

The exercise device 10 may include the first handle 190 and the second handle 200 with the first grip 180A and the second grip 180B, respectively. The first and second grips 180A, 180B of the first and second handles 190, 200 may include a first channel 480A and a second channel 480B formed therein for passage of the first and second elastic members 130, 140 therethrough, respectively. The first and second handles 190, 200 may optionally include first and second handle bases 490, 500 extending from the first and second grips 170A, 170B/180A, 180B, respectively. Each of the first and second handle bases 490, 500 is preferably separated from the first and second grips 170A, 170B/180A, 180B, respectively, to allow the fingers of a user's hand to pass therebetween. Such a configuration allows the user to insert four fingers between the grip and base of a handle and grasp the grip using his or her thumb and their fingers. This combination of grip and base allow the user to do push-ups more comfortably since the wrists are not as flexed.

Further advantages and features of the invention will be apparent from the remainder of this document in conjunction with the associated drawings.

DETAILED DESCRIPTION OF PREFERRED VERSIONS OF THE INVENTION

Figure 1:
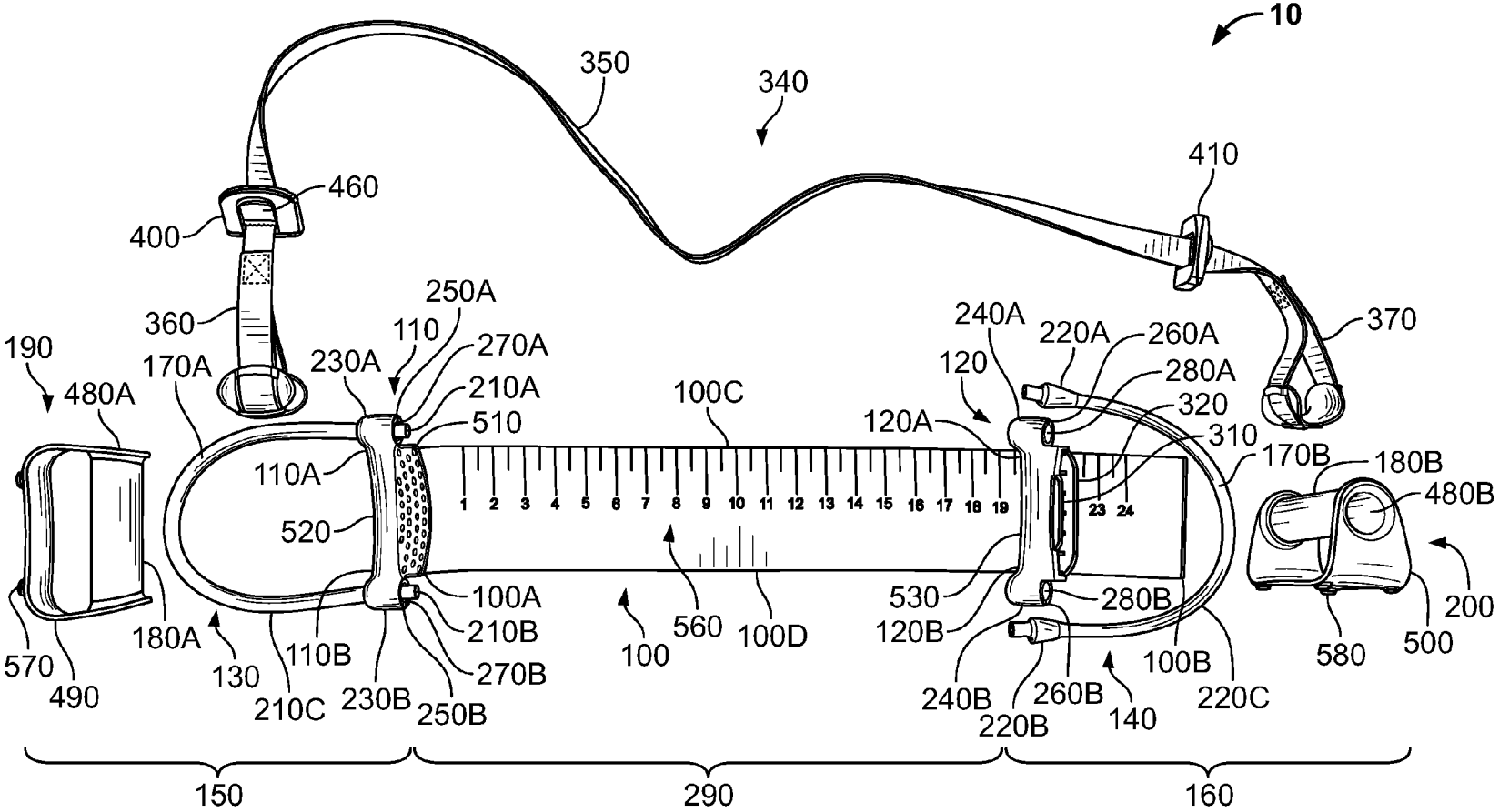
FIG. 1 is a front view of an exemplary exercise device 10 with a pair of elastic members 130, 140 securable to opposing ends 100A, 100B of a central webbing 100 via a pair of bridges 110, 120. Also shown are exemplary device anchor 340 and handles 190, 200 that can interface with the exercise device 10 via the elastic members 130, 140.

Returning to FIGS. 1 and 2, an exemplary exercise device 10 that illustrates preferred features of the invention is designated generally by the reference numeral 10. The flat central webbing 100 has a webbing length extending from a webbing first end 100A to a webbing second end 100B, a webbing width extending from a webbing first edge 100C to a webbing second edge 100D, and a webbing thickness extending from a webbing first face 100E to a webbing second face 100F (see also FIG. 2). In exemplary versions, the central webbing 100 length may be equal to or greater than eight inches, the webbing width may be equal to or greater than one inch, and the webbing thickness may be equal to or smaller than 0.25 inches. The version represented in FIGS. 1 and 2 includes a webbing length of about 24 inches, a webbing width of about four inches, and a webbing thickness of about 0.075 of an inch.

The central webbing 100 allows for a relatively large surface area of contact with the body (when, for example, the exercise device 10 is wrapped about the user's back). The central webbing 100 is preferably flexible/moldable/reshapable to allow it to conform to the shape of the body. Use of non-elastic material (such that the central webbing 100 does not substantially stretch during exercises) also makes the exercise device 10 more comfortable because, for example, a band that lengthens and shortens against the user's body could stretch and pinch the user's clothing and/or skin. The central webbing 100 may include a non-slip surface/material to further help stabilize the exercise device 10 during exercises such that, for example, the central webbing 100 does not slide against the back during repeated, alternating motions.

The first bridge 110 includes a first bridge width extending from a first bridge first side 110A to a first bridge second side 110B, and the second bridge 120 includes a second bridge width extending from a second bridge first side 120A to a second bridge second side 120B. Each of the first and second bridges 110, 120 extends between the webbing first and second edges 100C, 100D. In the version of the exercise device 10 shown in FIGS. 1 and 2, the first and second bridges 110,

120 directly contact the central webbing 100, and the first and second bridge widths are approximately equal to the webbing width.

Figure 2:
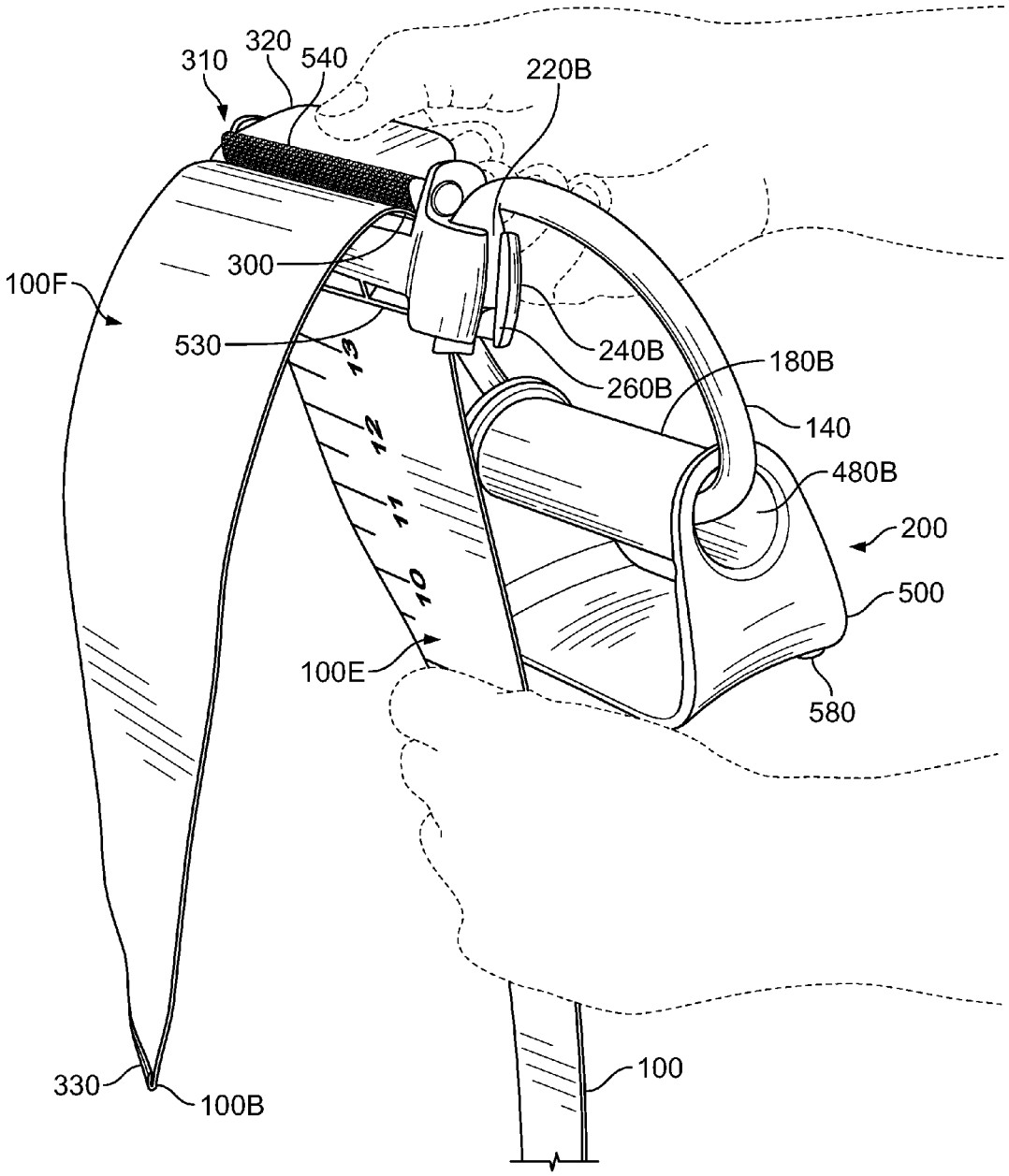
FIG. 2 is a close-up view of one of the bridges 110, 120 of the of the exercise device 10 of FIG. 1, with a user engaging a release lever 320 of a securing mechanism 310 to adjust a separation distance 290 between the bridges 110, 120.

As shown in FIGS. 1 and 2, the first bridge 110 may include a first bridge anchor 510 extending from a first bridge body 520. The webbing first end 100A is molded with the first bridge anchor 510, fixing the first bridge 110 at the webbing first end 100A. A cam mechanism 310 incorporated into a second bridge body 530 allows the second bridge 120 to be repositioned between the first bridge anchor 510 and the webbing second end 100B. In the grip state of the webbing release lever 320, the central webbing 100 is pinched between a lever surface 540 and a second bridge body 530, restricting the central webbing 100 from traversing the second bridge passageway 300. The lever surface 540 is preferably roughened/toothed/spiked to enhance the frictional grip on the central webbing 100. The cam mechanism 310 is spring-biased towards the grip state. When the webbing release lever 320 is pressed, it is moved into the release state, in which the lever surface 540 is separated from the second bridge body 530 (see FIG. 2). In the release state, the second bridge 120 can be brought closer to or moved farther apart from the first bridge 110 as the central webbing 100 traverses the second bridge passageway 300.

The central webbing 100 is substantially inelastic, such that when the first and second ends 100A, 100B of the central webbing 100 are pulled apart until the central webbing 100 is taut, the central webbing 100 does not substantially increase in length. The central webbing 100 and strapping member 350 may be made of (for example) inelastic nylon or polypropylene materials. The first and second bridges 110, 120, the first and second buckles 400, 410, and the first and second handles 190, 200 may be made of (for example) hard plastics. The cable cradles of the device anchor 340 may be made of (for example) relatively softer plastics.

To assemble the exercise device 10 of FIGS. 1 and 2, the first elastic member 130 is stretched such that its elastic member body 210C can traverse the cradle slit 250A of the first bridge first cradle 230A. If the first elastic member 130 will be serving as the grip 170A (which may be engaged by the hand, foot, arm, etc.), then the first elastic member 130 can be stretched to allow its elastic member body 210C to traverse the cradle slit 250A of the first bridge second cradle 230B. If the handle 190 is to be used, then the first elastic member 130 can be passed through the channel 480A formed through the first grip 180A before the elastic member body 210C is passed through the cradle slit 250B of the first bridge second cradle 230B. The first elastic member 130 can then be pulled (in a direction away from the second bridge 120 in the orientation as shown in FIG. 1) to lodge the elastic member bulbs 210A, 210B of the first elastic member 130 in the first bridge first and second cradles 230A, 230B. The same process can be repeated with the second elastic member 140, the second bridge 120, and the second handle 200. To assemble the exercise device 10 with the device anchor 340, a similar process can be repeated, with the first and second elastic members 130, 140 being passed through the anchor first loop 360 and the anchor second loop 370 instead of the first channel 480A and the second channel 480B of the first handle 190 and the second handle 200, respectively.

Figure 3:
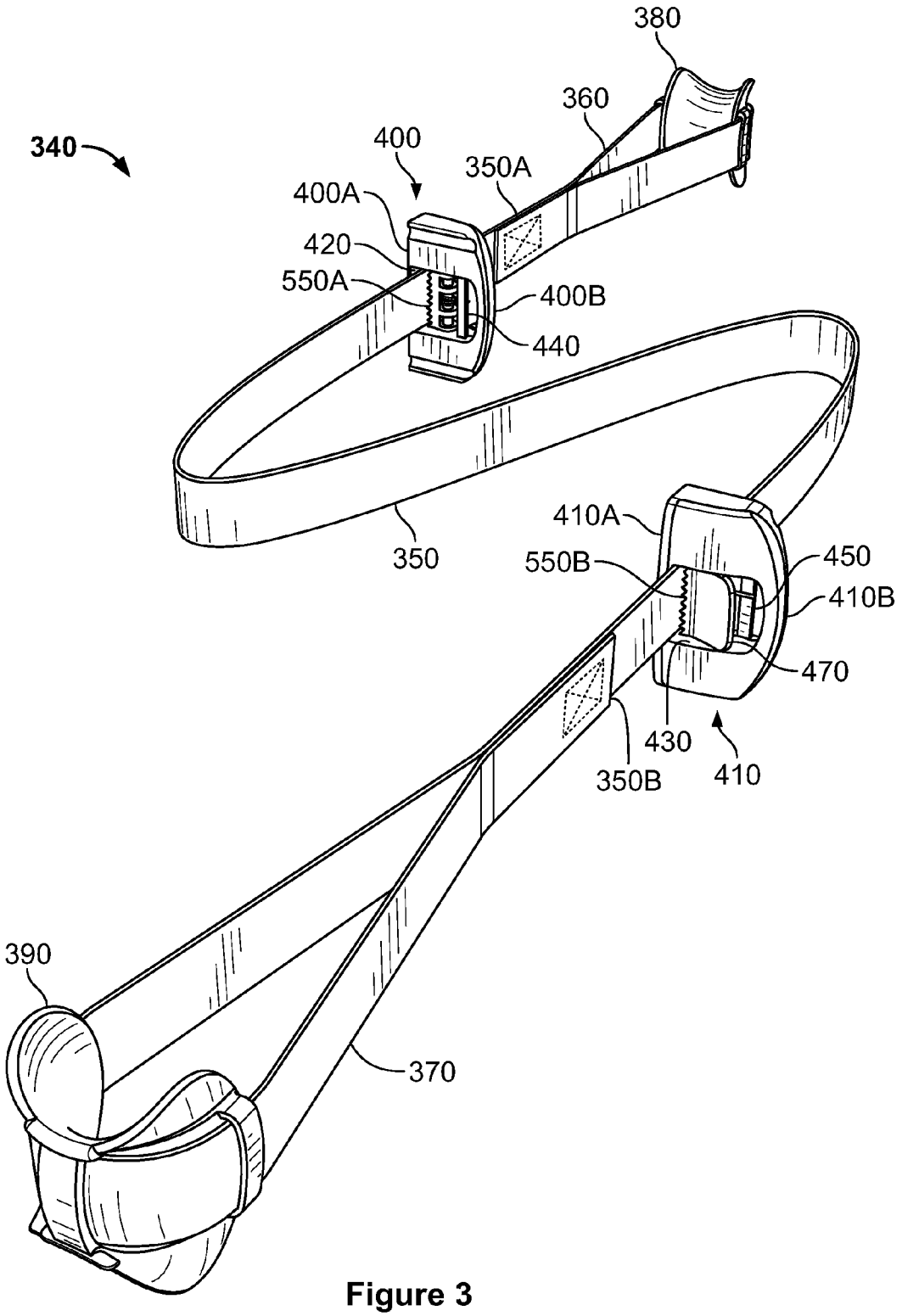
FIG. 3 is a perspective view of the device anchor 340 of FIG. 1, showing a pair of anchor loops 360, 370 at opposing ends 350A, 350B of an elongated strapping member 350, and a pair of anchor buckles 400, 410 that may be positioned at different positions along the strapping member 350.

To install the device anchor 340 of FIGS. 1 and 3 on a door (not pictured), the door is opened to widen the hinge side door frame gap. The buckle release levers 460, 470 of the first and second buckles 400, 410 are moved to their buckle release states to position the first buckle 400 at the intersection of the strapping first end 350A and the anchor first loop 360, and to position the second buckle 410 at the intersection of the strapping second end 350B and the anchor second loop 370. The strapping member 350 is passed around the back side of the door, opposite the side on which exercises are to be performed. The first buckle 400 may include a first buckle flat side 400A opposing a first buckle rounded side 400B, and the second buckle 410 may include a second buckle flat side 410A opposing a second buckle rounded side 410B. The flat sides 400A, 410A of the first and second buckles 400, 410 should face the door frame, and the rounded sides 400B, 410B of the first and second buckles 400, 410 should face the center of the door. The door should then be closed and locked. The anchor first and second loops 360, 370 are pulled to position the device anchor 340 such that an approximately equal length of the strapping member 350 extends through opposing sides of the door. The first and second buckles 400, 410 are again repositioned such that they are pressed against the door and door frame to minimize or prevent anchor device slippage during exercises. The first and second elastic members 130, 140 may then be run through the anchor first and second loops 360, 370 as discussed above. To use the device anchor 340 with a pole or fence instead of a door, the strapping member 350 may be wrapped or weaved around an anchor point of the pole or fence before the elastic members 130, 140 are run through the anchor loops 360, 370. It is noted that the device anchor 340 may be used with only of the anchor first and second loops 360, 370 interfacing with the exercise device 10 (such as with one or both of elastic members 130, 140 of the exercise device), leaving the other of the anchor first and second loops 360, 370 unused. If the device anchor is being used in this manner (that is, with only of the anchor first and second loops 360, 370 in use rather than both) with a door, the device anchor 340 could nonetheless be stabilized in the door by the first and second buckles 400, 410.

To perform exercises using the exercise device 10, a user may begin by setting the wide, flat, central webbing 100 at the desired resistance level by adjusting the separation distance 290 between the first and second bridges 110, 120. This can be done by sliding the second bridge 120 along the length of the central webbing 100. The central webbing 100 includes numbered markings 560 (on the webbing first face 100E) to indicate the separation distance 290 and consequently the extent to which the elastic members 130, 140 will be stretched during exercises, helping the user keep track of his/her progress over time. The opposing side (the webbing second face 100F) of the central webbing 100 can include instructions for various exercises, safety precautions, etc. (not pictured).

An elastic member 130, 140 with a desired elasticity/length (and consequently a desired level of resistance/intensity) can be chosen (elastic members can be color coded to help distinguish between elastic members having different resistances). The elastic members 130, 140 can be installed by lodging their bulbs/plugs 210A, 210B/220A, 220B into the cradles 230A, 230B/240A, 240B of the bridges 110, 120 after sliding them through the handles 190, 200 (when handles are being used), as discussed above. The wide handle bases 490, 500 of the handles 190, 200 provide stability when placed on the floor. To minimize slippage on the floor or other surface, the handle bases 490, 500 may include base feet 570, 580. The hollow grips 180A, 180B of the handles 190, 200 may receive the elastic members 130, 140 therethrough so that the elastic members 130, 140 will not pinch the user's hands during exercises. When used properly, the resistance of the elastic members 130, 140 can increase the intensity of exercise routines relative to the same routines performed without the exercise device 10. The following are exemplary exercises that may be performed with the exercise device 10.

To perform "chest expansion" exercises, the user can begin by holding the exercise device 10 out directly in front at chest height with arms parallel with the floor. The user should keep a very slight bend at the elbows throughout the exercise. Next, keeping arms straight and parallel with the floor, the user should pull his or her hands away from each other until they are positioned straight out from the user's sides. Then, the hands can be brought back to the center starting position where the hands are directly in front of the chest with arms still parallel with the floor. This can be repeated for a desired number of repetitions. To adjust the resistance of chest expansion exercises (as well as the resistance for other exercises, including the ones discussed below), the user may adjust the central webbing 100 (that is, adjust the separation distance 290 between the first and second bridges 110, 120) and/or replace the elastic members 130, 140 with other elastic members having a different elasticity and/or length.

For "tricep extensions," the handle 190 of the exercise device 10 can be taken in one hand and the arm lifted above the head. Next, the elbow can be bent so that the hand is behind the neck and in between the shoulder blades. The elbow should preferably be pointed at the ceiling, with the exercise device 10 hanging along the length of the back. Then, the user can reach down behind the back with the other hand, grabbing the other handle 200 of the exercise device 10. The back of the hand can be placed against the lower back so that it remains steady and supported while performing the exercise. Next the user can slowly extend his or her upper hand until the arm is almost straight. Then, the hand can be lowered to its starting position, trying to keep the elbow pointed at the ceiling. This can be repeated for a desired number of repetitions.

To perform "overhead pulls," the user can take one handle 190, 200 of the exercise device 10 in each hand and raise the arms above the head with hands pointed toward the ceiling. A slight bend should be maintained in the elbows. Keeping arms straight, the hands can be lowered until the arms are straight out from the shoulders, parallel with the floor. As the hands are brought down, they should be slightly behind the shoulders so that the central webbing 100 remains behind the head rather than in front of the user's face. Then, the hands can be raised back to their starting position above the head, keeping arms straight with a slight bend at the elbow. This can be repeated for a desired number of repetitions.

To perform "power pushups," the user may begin by looping the central webbing 100 of the exercise device 10 comfortably about the back. The wide, flat bases 490, 500 of the handles 190, 200 can be placed on the floor and the grips 180A, 180B grasped with the hands. The user can move into a pushup position, keeping the body straight and elbows slightly bent. The buttocks should preferably not sink toward the floor at any point during the exercise. The user can slowly bend his or her elbows, keeping them close to one's sides, until his or her body is just above the floor. Then, the user pushes himself/herself back up to the starting position until the elbows are almost straight. This can be repeated for a desired number of repetitions.

To perform the "power punch" exercise, the user may begin by looping the central webbing 100 of the exercise device 10 comfortably around the back. Next, the handles 190, 200 of the exercise device 10 can be gripped and arms placed in front in a boxing stance. The hands should be in front of the face with one slightly higher than the other. The feet may be staggered with one in front of the other and one's weight on the back foot. A bend should be kept in the knees throughout the exercise. The user can punch forward the first on the same side of the body as the front foot. The user may punch until the arm is almost straight, then immediately begin to draw it back. As the arm begins to come back to its starting position, the torso may be rotated and the other first punched forward. The hands may pass by each other at the midway point between the starting and ending positions. As the torso is rotated to bring the back arm forward, one's weight may shift to the front foot and the bend in the knee increased. After extending the back arm all the way forward, the back arm can be immediately drawn back. As this is done, the torso will rotate and the weight will again shift to the back foot. This can be repeated for a desired number of repetitions.

To use the exercise device 10 and device anchor 340 for "crunches," the device anchor 340 can be placed snugly in a door frame (as discussed above). The handles 190, 200 of the exercise device 10 can be detached, and the desired elastic members 130, 140 extended through the device anchor 340 and installed in the exercise device 10. The exercise device 10 will be attached to the device anchor 340 at both sides of the door frame. Next, the user can lie with the back on the floor and the exercise device 10 slid over the knees as he/she places the soles of the feet against the door. The lower legs should be parallel with the floor, and the central webbing 100 should comfortably rest over the thighs. Placing the central webbing 100 over the thighs will give the user support as crunches are performed. To perform a crunch, the arms can be crossed over the chest and the upper back slowly rolled off the floor until the bottoms of the shoulder blades are no longer touching the floor. The user should take care not to strain the neck and to keep the chin and eyes aimed toward the ceiling. Next, with the chin and eyes still directed at the ceiling, the user can slowly lower himself/herself back down until the head almost touches the floor. This can be repeated for a desired number of repetitions.

To use the exercise device 10 and device anchor 340 for "reverse crunches," the device anchor 340 can be placed snugly in a door frame (as discussed above). The handles 190, 200 of the exercise device 10 can be detached, and the desired elastic member 130, 140 slid through the device anchor 340 and installed in the exercise device 10. The exercise device 10 will be attached to the device anchor 340 at both sides of the door frame. Next, the user can lie with the back on the floor and the exercise device 10 slid over the knees. The user can push himself/herself out from the door to provide adequate room to perform the reverse crunches. The lower legs should be parallel with the floor, and the central webbing 100 should be comfortably resting over the thighs. To perform a reverse crunch, the hands can be placed behind the head. The user should take care not to pull on the head or strain the neck during the exercise. The chin and eyes should be directed toward the ceiling. The top of the shoulder blades should preferably be just off the floor. Next, the knees can be pulled toward the chest while the central webbing 100 rests comfortably over the thighs. The shoulder blades will come up off the floor simultaneously until the knees and the chest meet. Then, the shoulder blades can be lowered back to the floor as the legs are moved back to their starting position with the lower legs parallel with the floor. This can be repeated for a desired number of repetitions.

Initially, it must be kept in mind that the exercise device 10 shown in the accompanying drawings and discussed above is merely exemplary, and may assume a wide variety of configurations different from those noted, and may use components different from those noted.

It should also be understood that terms referring to orientation and position are relative terms rather than absolute ones. Thus, terms such as "top," "bottom," "forward," "rearward," "leftward," "rightward," etc. should be regarded as words of convenience rather than limiting terms. It should be understood that components may in fact be located in different relative positions depending on the overall orientation and configuration of the apparatus.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, the central webbing 100 need not be a single band having a linear, rectangular configuration as shown in FIGS. 1 and 2. For example, the central webbing 100 may have a tapered, hourglass, oval, or any other shape deemed appropriate. Moreover, multiple strips/bands of central webbing 100 may be incorporated between a pair of bridges 110, 120. Additionally or alternatively, multiple bridges may be used at each end/side of the central webbing 100.

Second, instead of a central webbing 100 linearly extending from a webbing first end 100A to a webbing second end 100B, the ends 100A, 100B of the central webbing 100 may be wrapped around to form a loop or belt. The separation distance 290 between the first and second bridges 110, 120 may be adjustable, for example, by adjusting a belt buckle secured to the looped/belted central webbing 100.

In a "true loop" configuration, the bridges 110, 120 may incorporate closed slots that allow the central webbing 100 to freely pass therethrough. The buckle is free to move between the bridges 110, 120. One end of the central webbing 100 could be attached to the buckle. The other end could pass through one bridge slot, the other bridge slot, and back to the buckle. At the buckle, the free end is passed through a cam buckle opening under a cam lever and out. The free end is used to pull webbing out of the loop, causing the distance between the bridges to shorten. In one variation, one of the bridges may be slightly tighter or fixed to the webbing near the free buckle. This arrangement pulls one bridge 110 towards the other 120. In another variation, the buckle may snap onto a bridge.

In an "anchored loop" configuration, the belt buckle may be integrated into one of the bridges 110, 120, which is secured to the central webbing 100. The free end of the looped/belted webbing then passes through the closed webbing slot in the other bridge and back to the buckle. At the buckle the free end is passed through the cam buckle opening under the cam lever and out. The free end is used to pull webbing out of the loop, causing the distance between the bridges 110, 120 to shorten.

Third, although FIGS. 1 and 2 show that the elastic members 130, 140 pass through channels 480A, 480B formed in handles 190, 200, and are secured to the bridges 110, 120 via cradles 230A, 230B/240A, 240B, the manner of securing the elastic members 130, 140 to the bridges 110, 120 and handles 190, 200 (and the configuration of the first and second loops 150, 160 discussed above formed by the bridges 110, 120 and elastic member 130, 140) can be greatly varied. For example, a channel may be incorporated into each bridge 110, 120 in addition to (or instead of) the cradles 230A, 230B/240A, 240B of the bridges 110, 120. Additionally or alternatively, "slotted" handles may incorporate one or more cradles, in addition to (or instead of) having channels 480A, 480B extending through grips 180A, 180B. In one configuration that uses one elastic member, one end of the elastic member may be secured to a cradle in the slotted handle, the elastic member may be passed through a channel formed in the bridge (a "bridge channel"), and the other end of the elastic member may loop back to be secured to a another cradle in the slotted handle. One advantage of eliminating cradles from the bridges (and, for example, replacing them with channels) is that the bridges could be less bulky, such that the cradles would not contact the user's back or chest during exercises.

Fourth, although a pair of cradles on opposing sides of the bridge is shown in FIGS. 1 and 2, more than two cradles may be incorporated into the bridges (such as two cradles on each side of each bridge). If, for example, the bridge and slotted handle each includes three cradles, up to three bulbed elastic members may be extended between the bridge and the handle. In particular, use of three cradles in each of the bridge and handle has been found to balance the load on the bridge and handle.

Fifth, a foam rotator may be incorporated into a grip 180A, 180B of the handle 190, 200, allowing the user to perform pushups more comfortably as the foam-covered handle 190, 200 is trapped between the floor and the user's hand. Alternatively, a pushup type stand could be integrated into the handle 190, 200. For example, the handle 190, 200 shown in FIGS. 1 and 2 (having a grip 180A, 180B with a tubular channel 480A, 480B formed therein) could be connected by webbing to a cradle. The elastic member ends could be secured directly to the cradle instead of the handle 190, 200.

Sixth, although one bridge 110 is shown as fixedly secured to the central webbing 100, while another bridge 120 is shown as adjustably secured to the central webbing 100 at a position between the webbing first end 100A and the webbing second end 100B, the bridges 110, 120 need not be so configured. For example, both bridges 110, 120 may be fixedly secured to the central webbing 100 at any position along the length of the central webbing 100, or both bridges 110, 120 may be adjustably secured to the central webbing 100.

Seventh, although the exercise device 10 of FIGS. 1 and 2 allows for removable and interchangeable elastic members 130, 140, the exercise device 10 could instead incorporate one or more elastic members that are fixedly secured to the exercise device 10 and not exchangeable. For example, first and second elastic members 130, 140 may be fixedly secured to the first and second bridges 110, 120, respectively. Difficulty/intensity of exercise routines could be adjusted by adjusting the separation distance 290 of the bridges 110, 120, if the separation distance 290 is adjustable.

Eight, although FIGS. 1 and 2 show the bridges 110, 120, elastic members 130, 140, and grips 170A, 170B/180A, 180B forming a loop on opposing ends 100A, 100B of the central webbing 100, the exercise device 10 may be configured to have elastic members linearly extending from the bridges 110, 120 to grips 180A, 180B of handles 190, 200. Such elastic members could be (for example) flat bands rather than cylindrical in shape, and they could be exchangeable with other elastic members having different elasticities/lengths, or they could be fixedly secured to bridges 110, 120 and/or grips 180A, 180B. Such elastic members could be exchangeably secured to the handles 190, 200 using (for example) cradles, or they could be fixedly secured to the handles 190, 200 by being molded thereto.

Ninth, although the webbing first end 100A has been molded into the first bridge 110, the first bridge 110 may include a slot through which central webbing 100 may pass. The central webbing 100 could be sewn at the webbing first end 100A to resist being pulled through the slot in the first bridge 110. This could be used to allow small-runs of custom webbing into standard molded parts. Moreover, the webbing could be customized with graphic logos, colors, instructions, etc.

Tenth, although the bridges 110, 120 in FIGS. 1 and 2 are secured to the central webbing 100 through direct contact, the bridges 110, 120 may instead be secured to the central webbing 100 at (for example) one or more points using tabs running from the bridges to the webbing, with the tabs being riveted or otherwise joined to the webbing.

Eleventh, although the version in FIGS. 1 and 2 show first and second loops formed using first and second elastic members, each of the first and second loops can be formed with multiple elastic members. That is, loops on opposing ends of the central webbing can be formed/drawn using one or more elastic members, handles, bridges, and any parts thereof. For example, one loop may be formed by a first bridge, a first elastic member, portions of a first handle, and a second elastic member, with both of the first and second elastic members extending between the first bridge and the first handle.

Twelfth, the version of band 100 described and pictured is webbing made of polypropylene. Use of such webbing may have the advantages of being relatively simple and low cost. However, element 100 could be replaced by other structures made of different materials and having different configurations. For example, central webbing 100 could be replaced with any alternative structure that would provide one or more of: a large surface area of contact with the body; conformity to the shape of the body; and inelasticity.

Preferred versions of the invention have been described above in order to illustrate how to make and use the invention. The invention is not intended to be limited to these versions, but rather is intended to be limited only by the claims set out below. Thus, the invention encompasses all different versions that fall literally or equivalently within the scope of these claims.

What is claimed is:

1. An exercise device usable for various exercises in multiple configurations, a. the device including:

i. a central webbing having:

1) a webbing width extending from a webbing first edge to a webbing second edge; and 2) a webbing thickness extending from a webbing first face to a webbing second face, the webbing thickness being substantially less than the webbing width;

ii. a first bridge and a second bridge, each of the first and second bridges being secured to the central webbing; and iii. a first elastic member extending from the first bridge, and a second elastic member extending from the second bridge, the first and second elastic members being removably and replaceably securable to the first and second bridges, respectively;

b. whereby when the central webbing is taut, the first and second elastic members may be stretched to exert energy during exercises;

c. wherein:

i. the first bridge includes a first bridge first cradle and a first bridge second cradle on opposing sides thereof;

ii. the second bridge includes a second bridge first cradle and a second bridge second cradle on opposing sides thereof;

iii. the first and second elastic members are securable to the first and second bridges via the cradles thereof, respectively;

iv. each cradle includes a cradle slit opening onto a cradle passageway; and v. each of the first and second elastic members includes a pair of elastic member bulbs on opposing ends of an elastic member body, the elastic member body of each elastic member is sized such that an unstretched elastic member body is restricted from passing through the cradle slit opening.

2. The exercise device of claim 1 further including a first loop formed by the first bridge and the first elastic member, and a second bop formed by the second bridge and the second elastic member.

3. The exercise device of claim 2 wherein:

a. the first and second loops are further formed by a first and second grip, respectively; and b. the first and second grips include at least one of:

i. a portion of the first and second elastic members, respectively; and ii. a first channel and a second channel formed therein, respectively, for passage of the first and second elastic members therethrough, respectively.

4. The exercise device of claim 1 wherein:

a. each cradle includes a cradle long axis; and b. the elastic member bulbs are complementarily receivable within each cradle such that the elastic member bulbs are:

i. restricted from exiting the cradle in a first direction along the cradle long axis; and ii. relatively unrestricted from exiting the cradle in an opposing second direction along the cradle long axis.

5. The exercise device of claim 4 further including a first grip and a second grip, wherein when the first and second elastic members are stretched while exercising, the first and second grips move farther away from the first and second bridges, respectively.

6. The exercise device of claim 5 further including a first handle and a second handle, wherein:

a. the first and second grips are part of the first and second handles, respectively;

b. the first and second grips include first and second channels, formed therethrough, respectively;

c. the first elastic member extends from the first bridge, passes through the first channel, and returns to the first bridge; and d. the second elastic member extends from the second bridge, passes through the second channel, and returns to the second bridge.

7. The exercise device of claim 6 wherein:

a. the first and second handles further include first and second handle bases, respectively;

b. each of the first and second handle bases is separated from the first and second grips, respectively, to allow one or more fingers of a hand to pass therebetween.

8. The exercise device of claim 1 wherein:

a. the first bridge and the second bridge are spaced a bridge separation distance apart;

b. the bridge separation distance is adjustable by adjusting the relative position at which the first and second bridges are secured to the central webbing;

c. decreasing the separation distance increases exertion during exercises by increasing the length to which the first and second elastic members are stretched during repeating exercise motions.

9. The exercise device of claim 8 wherein the second bridge includes:

a. a second bridge passageway;

b. a webbing securing mechanism biased to secure the second bridge to the central webbing, the webbing securing mechanism having a webbing release lever that is movable between:

i. a grip state in which the central webbing is restricted from passing through the second bridge passageway by the webbing securing mechanism; and ii. a release state in which the central webbing is not restricted from passing through the second bridge passageway by the webbing securing mechanism.

10. The exercise device of claim 1 further including a device anchor for anchoring the exercise device to a structure, the device anchor having an elongated strapping member:

a. extending from a strapping first end to a strapping second end; and b. having an anchor first loop situated at the strapping first end, and an anchor second loop situated at the strapping second end, the anchor first and second loops able to receive the first and second elastic members therethrough, respectively.

11. The exercise device of claim 10 wherein the device anchor further includes a first buckle and a second buckle, each of the first and second buckles having:

a. a buckle passageway through which the strapping member passes; and b. a buckle securing mechanism biased to secure the respective buckle to the strapping member, the buckle securing mechanism having a buckle release lever that provides:

i. a buckle grip state in which the strapping member is restricted from passing through the buckle passageway by the buckle securing mechanism; and ii. a buckle release state in which the strapping member is not restricted from passing through the buckle passageway by the buckle securing mechanism.

12. The exercise device of claim 1 wherein the central webbing is substantially inelastic, such that when opposing ends of the central webbing are pulled apart until the central webbing is taut, the central webbing does not substantially increase in length.

13. The exercise device of claim 1 wherein:

a. the central webbing includes a webbing long axis;

b. each cradle includes a cradle long axis; and c. the central webbing long axis is at least substantially parallel with the cradle long axis of each cradle when the central webbing is substantially planar and taut.

14. An exercise device usable for various exercises in multiple configurations, a. the device including:

i. a substantially inelastic central webbing;

ii. a first bridge and a second bridge, the first and second bridges securable to the central webbing, each of the first and second bridges having at least one of:

1) a bridge channel; and 2) a bridge cradle;

iii. a first grip and a second grip, each of the first and second grips having at least one of:

1) a grip channel; and 2) a grip cradle;

iv. a first elastic member extending between the first bridge and the first grip, the first elastic member securable to:

1) the bridge channel or the bridge cradle of the first bridge; and 2) the grip channel or the grip cradle of the first grip; and v. a second elastic member extending between the second bridge and the second grip, the second elastic member securable to:

1) the bridge channel or the bridge cradle of the second bridge; and 2) the grip channel or the grip cradle of the second grip; and b. whereby when exercises are being performed:

i. the central webbing is pulled tight; and ii. the first grip is separated from and brought closer to the first bridge, and the second grip is separated from and brought closer to the second bridge.

15. The exercise device of claim 14 wherein:

a. the second bridge further includes a cam mechanism for allowing the second bridge to be adjustably securable to the central webbing at different positions relative to the first bridge, the cam mechanism having:

i. a grip state in which the central webbing is pinched between a pair of surfaces; and ii. a release state in which the pair of surfaces are separated to allow the central webbing to pass therebetween; and b. the cam mechanism is spring-biased towards the grip state.

16. The exercise device of claim 14 wherein the central webbing includes:

a. a webbing length extending from a webbing first end to a webbing second end, the webbing length being equal to or greater than eight inches;

b. a webbing width extending from a webbing first edge to a webbing second edge, the webbing width being equal to or greater than one inch; and c. a webbing thickness extending from a webbing first face to a webbing second face, the webbing thickness being no greater than 0.25 of an inch.

17. An exercise device usable for various exercises in multiple configurations, a. the device including:

i. a substantially flat central webbing;

ii. a first loop and a second loop at opposing ends of the central webbing, the first and second loops being formed by:

1) a first bridge and a second bridge, respectively, the first and second bridges being secured to the central webbing;

2) a first elastic member and a second elastic member, respectively; and 3) a first grip and a second grip, respectively;

b. wherein:

i. the central webbing is substantially less elastic than both the first and second elastic members and includes a webbing width extending from a webbing first edge to a webbing second edge;

ii. the first bridge includes:

1) a first bridge width extending from a first bridge first side to a first bridge second side, the first bridge width being at least substantially half the webbing width; and 2) a first bridge first cradle situated at the first bridge first side, and a first bridge second cradle situated at the first bridge second side, the first bridge first and second cradles forming part of the first loop;

iii. the second bridge includes:

1). a second bridge width extending from a second bridge first side to a second bridge second side, the second bridge width being at least substantially half the webbing width;

2). a second bridge first cradle situated at the second bridge first side, and a second bridge second cradle situated at the second bridge second side, the second bridge first and second cradles forming part of the second loop;

3). a second bridge passageway for receiving the central webbing therethrough;

4). a webbing securing mechanism biased to secure the second bridge to the central webbing, the webbing securing mechanism having a webbing release lever movable between:

a. a grip state in which the central webbing is restricted from passing through the second bridge passageway by the webbing securing mechanism;

b. a release state in which the central webbing is not restricted from passing through the second bridge passageway by the webbing securing mechanism;

iv. the circumferences of the first and second loops increase as the first and second elastic members, respectively, are stretched;

v. each of the first and second elastic members includes a pair of elastic member bulbs on opposing ends of an elastic member body;

vi. each cradle includes a cradle slit opening onto a cradle passageway;

vii. the elastic member body of each elastic member is sized such that an unstretched elastic member body is restricted from passing through the cradle slit opening;

viii. the elastic member bulbs are complementarily receivable in the bridge cradles to secure the first and second elastic members to the first and second bridges, respectively; and ix. a separation distance between the first bridge and the second bridge is adjustable when the webbing release lever of the webbing securing mechanism is in the release state;

c. whereby the first and second elastic members may be stretched using the first and second grips, respectively, to perform various exercises.

* * * * *